US009517906B2

(12) United States Patent
Nishimura

(10) Patent No.: US 9,517,906 B2
(45) Date of Patent: Dec. 13, 2016

(54) CONVEYING GUIDE, SHEET CONVEYING APPARATUS, AND IMAGE FORMING APPARATUS

(71) Applicant: CANON KABUSHIKI KAISHA, Tokyo (JP)

(72) Inventor: Yutaka Nishimura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/963,134

(22) Filed: Aug. 9, 2013

(65) Prior Publication Data

US 2014/0062010 A1 Mar. 6, 2014

(30) Foreign Application Priority Data

Aug. 29, 2012 (JP) ..... 2012-188454

(51) Int. Cl.
*B65H 5/38* (2006.01)
*B65H 9/00* (2006.01)
*B65H 5/06* (2006.01)

(52) U.S. Cl.
CPC *B65H 9/00* (2013.01); *B65H 5/06* (2013.01); *B65H 5/38* (2013.01); *B65H 2404/15* (2013.01); *B65H 2404/17* (2013.01); *B65H 2404/512* (2013.01); *B65H 2404/52* (2013.01)

(58) Field of Classification Search
CPC ..... B65H 2404/52; B65H 2404/521; B65H 2404/5211; B65H 2404/522; B65H 2404/5221; B65H 2404/1342; B65H 2404/17; B65H 5/06; B65H 5/38
USPC ..... 271/264, 272; 399/364, 401
See application file for complete search history.

(56) References Cited

U.S. PATENT DOCUMENTS

| | | | | |
|---|---|---|---|---|
| 5,652,647 | A | 7/1997 | Yashiro et al. | |
| 5,689,774 | A | 11/1997 | Shishido et al. | |
| 5,824,408 | A | 10/1998 | Kume et al. | |
| 6,023,597 | A | 2/2000 | Mayuzumi et al. | |
| 6,185,405 | B1 * | 2/2001 | Sueoka | 399/367 |
| 6,260,844 | B1 * | 7/2001 | Naeser et al. | 271/272 |
| 6,308,028 | B1 | 10/2001 | Yashiro et al. | |
| 6,336,629 | B1 * | 1/2002 | Carter et al. | 271/274 |
| 7,355,763 | B2 * | 4/2008 | Furihata | 358/474 |
| 7,559,550 | B2 | 7/2009 | Nam | |
| 7,669,848 | B2 * | 3/2010 | Watanabe | B65H 3/06 271/264 |
| 2005/0098943 | A1 | 5/2005 | Nam | |

(Continued)

FOREIGN PATENT DOCUMENTS

| | | | |
|---|---|---|---|
| CN | 1090657 | A | 8/1994 |
| CN | 1515421 | A | 7/2004 |

(Continued)

OTHER PUBLICATIONS

European Search Report issued in counterpart European Patent Application 13180989.9, dated Dec. 2, 2014.

(Continued)

*Primary Examiner* — Ernesto Suarez
(74) *Attorney, Agent, or Firm* — Fitzpatrick, Cella, Harper & Scinto

(57) ABSTRACT

A conveying guide includes: a plate having a guide surface which guides a sheet; a recess portion provided on the plate and recessed from the guide surface; and a bend portion bent from the recess portion in a direction away from the guide surface.

30 Claims, 5 Drawing Sheets

(56) References Cited

U.S. PATENT DOCUMENTS

| | | | | |
|---|---|---|---|---|
| 2008/0036141 | A1* | 2/2008 | Liu et al. | 271/274 |
| 2013/0142556 | A1 | 6/2013 | Nishimura | |
| 2013/0285318 | A1* | 10/2013 | Yamaguchi | 271/264 |
| 2014/0191469 | A1* | 7/2014 | Tamura | 271/272 |

FOREIGN PATENT DOCUMENTS

| | | | | |
|---|---|---|---|---|
| EP | 0586046 | A2 | | 3/1994 |
| EP | 0586046 | B1 | | 3/1994 |
| JP | 06-92505 | A | | 4/1994 |
| JP | 2669266 | B2 | | 4/1994 |
| JP | 06092505 | A | * | 4/1994 |
| JP | 11-153919 | A | | 6/1999 |
| JP | 2001-097604 | A | | 4/2001 |
| JP | 2004-067321 | A | | 3/2004 |
| JP | 2005-138966 | A | | 6/2005 |
| JP | 2006-347678 | A | | 12/2006 |
| JP | 4498226 | A | | 7/2010 |

OTHER PUBLICATIONS

Chinese Office Action issued in Corresponding Chinese Application No. 201310376091.4 dated Jun. 26, 2015.

* cited by examiner

CONVEYING GUIDE, SHEET CONVEYING APPARATUS, AND IMAGE FORMING APPARATUS

BACKGROUND OF THE INVENTION

1. Field of the Invention

The present invention relates to a conveying guide which guides a sheet, a sheet conveying apparatus including the conveying guide, and an image forming apparatus including the sheet conveying apparatus.

2. Description of the Related Art

The image forming apparatus includes a pair of conveying guides and a conveying path. The conveying guides are configured to guide both sides of a sheet, and the conveying path is provided as a roller or a belt. In the case where any projection or catch, which may interrupt the sheet conveyance, is formed on a conveying surface of the conveying guide, the projection or catch may cause a sheet jam or a sheet corner folding. Therefore, the conveying surface needs to be formed smooth.

However, the conveying guide is required to include a hole for projecting a conveying roller from the conveying surface or a slit provided at a junction of the conveying paths. To solve this, some techniques have been proposed as follows: in Japanese Patent Laid-Open No. 2006-347678, a biasing member is provided to guide a sheet so that a front end of the sheet may be away from a hole formed on a conveying surface, and in Japanese Patent Laid-Open No. 2004-67321, air is applied to bias a sheet toward a conveying path.

Meanwhile, beside the above-described functional shapes such as the hole and the slit, there are many cases where a bearing which supports a conveying roller is fitted into the conveying guide and its bearing support portion is attached to a back surface of the conveying surface to support the bearing. Recently, in particular, as higher image quality and speed-up are required in the image forming apparatus, there are an increasing number of cases where the conveying guide is formed from a plate so as to prevent a sheet from clinging to the conveying guide due to electrification.

Further, in the case where a support portion such as the bearing support portion is integrally formed by bending up from the conveying guide, a bend relief is made in course of the bending-up process and an edge of the bend relief appears on the conveying surface. Particularly, since the bearing support portion is bent up in a direction orthogonal to a sheet conveying direction, the edge of the bend relief may project in a direction in which the conveying sheet may get caught. To solve this, a method is generally employed in which an additional member which supports the bearing is attached to the conveying guide by welding or screwing so as to support the bearing and avoid the process on the conveying surface.

However, in this configuration of attaching the additional member, the number of parts increases, resulting in cost increase. Further, the weight of the parts will increase, which may hinder the improvement of user's operability and serviceman's workability.

SUMMARY OF THE INVENTION

In view of the above circumstances, the present invention provides a conveying guide capable of eliminating projection of a bend relief portion from a conveying surface and also reducing occurrence of a sheet jam or damage on an image surface caused by the sheet being caught at the bend relief portion.

A conveying guide includes: a plate having a guide surface which guides a sheet; a recess portion provided on the plate and recessed from the guide surface; and a bend portion bent from the recess portion in a direction away from the guide surface.

A sheet conveying apparatus includes: a guide portion which is provided on a plate and guides a sheet to be conveyed; a recess portion provided on the plate and recessed from the guide portion; a bend portion bent from the recess portion in a direction in which the recess portion is recessed from the guide portion; and a rotating portion rotatably supported at the bend portion, wherein the rotating portion rotates around an axis along a sheet width direction orthogonal to a sheet conveying direction.

Further features of the present invention will become apparent from the following description of exemplary embodiments with reference to the attached drawings.

DESCRIPTION OF THE EMBODIMENTS

In the following, an embodiment of the present invention will be described in detail with reference to the drawings. Further, the embodiment described hereinafter is only an example of the present invention and therefore it should be understood that the scope of the present invention is not limited to what is recited hereinafter, such as dimension, quality of material, shape and relative arrangement for each component, unless otherwise particularly specified.

Figure 1:
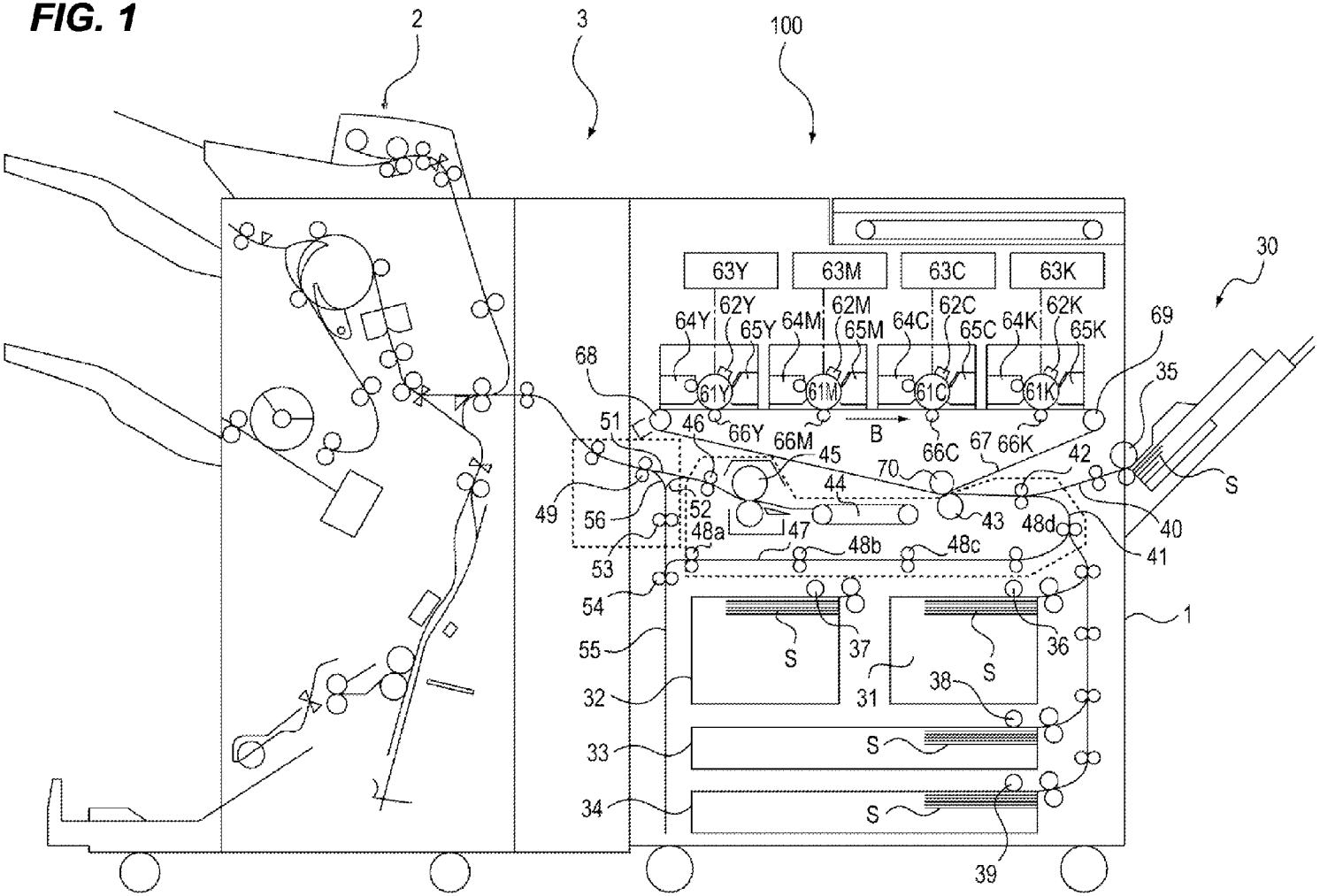
FIG. 1 is a cross-sectional view illustrating a configuration of an image forming apparatus.

FIG. 1 is a cross-sectional view illustrating a configuration of an image forming apparatus 100. As illustrated in FIG. 1, the image forming apparatus 100 includes an image forming apparatus body (hereinafter referred to simply as "apparatus body 1"), a buffer unit 3, and a post-processing device 2.

A sheet S is stacked and stored in any of sheet storage portions 30 to 34 and fed by feeding rollers 35 to 39 in synchronization with an image forming timing. Then, the sheet S is conveyed to a registration roller 42 through a conveying path 40 or 41. The registration roller 42 has a function of correcting skew feeding, that is, the sheet S conveyed from the sheet storage portions 30 to 34 is abutted on the registration roller 42 to form a loop, thereby aligning a front end of the sheet S and correcting the skew feeding. Further, the registration roller 42 has another function of conveying the sheet S to a secondary transfer portion at a predetermined timing when an image is formed on the sheet S, that is, in synchronization with a toner image borne on a photosensitive drum 61.

With the above two functions, the registration roller 42 conveys the sheet S to the secondary transfer portion at a desired timing after correcting the skew feeding. The secondary transfer portion is provided as a toner image transfer nip portion including a secondary transfer inner roller 70 and a secondary transfer outer roller 43. At the secondary transfer portion, a toner image is transferred onto the sheet S by imparting a predetermined pressing force and an electrostatic load bias.

An image forming portion which forms an image includes photosensitive drums 61 (61Y, 61M, 61C, 61K), charging devices 62 (62Y, 62M, 62C, 62K), exposure devices 63 (63Y, 63M, 63C, 63K), and development devices 64 (64Y, 64M, 64C, 64K). Further, the image forming portion includes primary transfer units 66 (66Y, 66M, 66C, 66K) and photosensitive body cleaners 65 (65Y, 65M, 65C, 65K).

The charging device 62 evenly charges a surface of the photosensitive drum 61. Next, the exposure device 63 forms an electrostatic latent image on the surface of the charged photosensitive drum 61 based on a transmitted image information signal. Subsequently, the development device 64 develops the electrostatic latent image formed on the photosensitive drum 61 with toner to form a toner image.

After that, a predetermined pressing force and an electrostatic load bias are imparted by the primary transfer unit 66 so that the toner image is transferred onto an intermediate transfer belt 67 from the photosensitive drum 61. Then, a small amount of residual transfer toner remaining on the photosensitive drum 61 is recovered by the photosensitive body cleaner 65 so as to be prepared for next image forming. In case of FIG. 2, four sets of the image forming portions, yellow (Y), magenta (M), cyan (C), and black (K), are provided. Of course, the number of colors is not limited to four, and the order of colors is not limited to this example, either.

Next, the intermediate transfer belt 67 will be described. The intermediate transfer belt 67 is tensed and entrained about a drive roller 68, a tension roller 69, and the secondary transfer inner roller 70, and is driven and conveyed in a direction indicated by an arrow B in FIG. 1. The image forming processes of respective colors, which are concurrently performed by the above-described image forming portions of yellow (Y), magenta (M), cyan (C), and black (K), are performed when a toner image is superposed on the upstream toner image primary-transferred onto the intermediate transfer belt 67. As a result, a full-color toner image is finally formed on the intermediate transfer belt 67 and then conveyed to the secondary transfer portion.

With the above-described processes, the full-color toner image is secondary-transferred onto the sheet S in the secondary transfer portion. After that, the sheet S is conveyed to a fixing device 45 by a pre-fixing conveying belt 44. The fixing device 45 melts and fixes the toner image onto the sheet S, using a predetermined pressing force generated by the facing rollers or the belt as well as giving the heating effect by a heat source such as a heater, in general. The sheet S having the fixed image thus obtained is conveyed to a discharge conveying path 51 via an inner discharge roller 46 so as to be directly discharged from the apparatus body 1. Alternatively, in the case where the duplex image formation is required, the sheet S is conveyed to a reverse guide path 52.

In the case where the duplex image formation is required, the sheet S is delivered to a switchback path 55 from the reverse guide path 52, passing through an upper reverse roller 53 and a lower reverse roller 54. Then, the rotating direction of the lower reverse roller 54 is switched over to the opposite direction (switchback operation). Then, the front end of the sheet S is switched over to the other end and the sheet S is conveyed to a duplex conveying path 47. After that, the sheet S passes through conveying rollers 48*a* to 48*d* and re-joins in synchronization with a sheet S of a subsequent job conveyed from the feeding rollers 35 to 39. Then, the sheet S is conveyed to the secondary transfer portion through the registration roller 42 in the same manner.

The image forming process performed onto the backside (second surface) is similar to that of the surface (first surface). Therefore, the detailed description thereof is omitted herein. Further, when the sheet S is reversely discharged, the sheet S is retracted from the reverse guide path 52 to the switchback path 55. Then, the sheet S is conveyed in a direction opposite to the delivery direction by the reverse rotation of the upper reverse roller 53 and the lower reverse roller 54 while the rear end of the sheet S at the time of delivery is set to the leading position, and the sheet S is discharged from the apparatus body 1 via a reverse discharge path 56.

Figure 2:
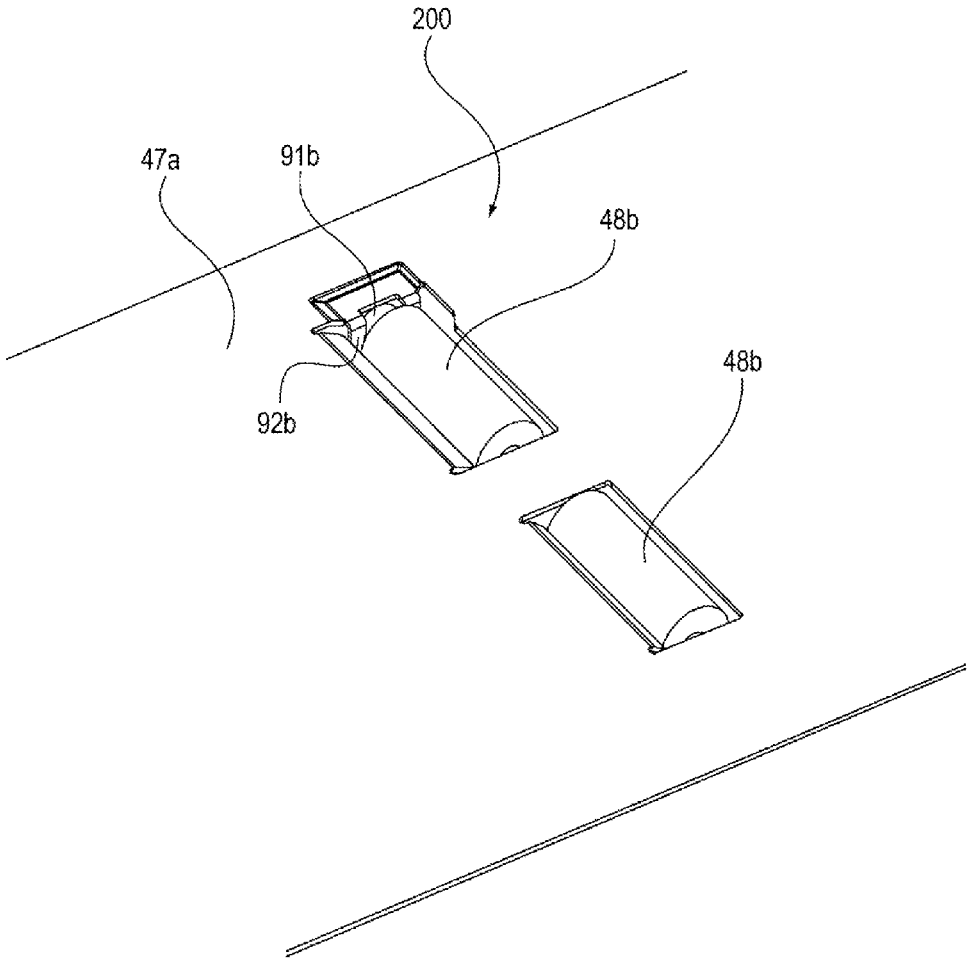
FIG. 2 is a perspective view seen from a conveying surface side, illustrating a peripheral part of a duplex roller of a duplex conveying path.
Figure 3:
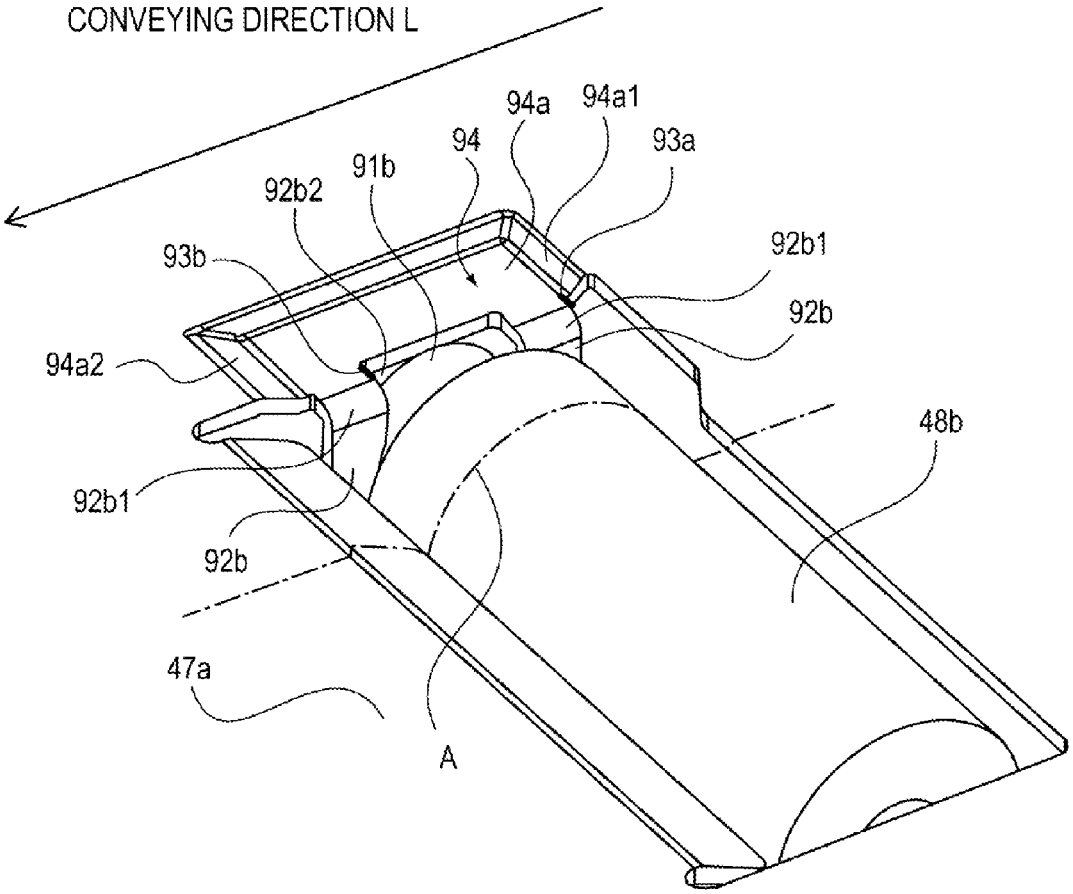
FIG. 3 is an enlarged perspective view of FIG. 2 seen from the conveying surface side, illustrating a peripheral part of a roller bearing.
Figure 4:
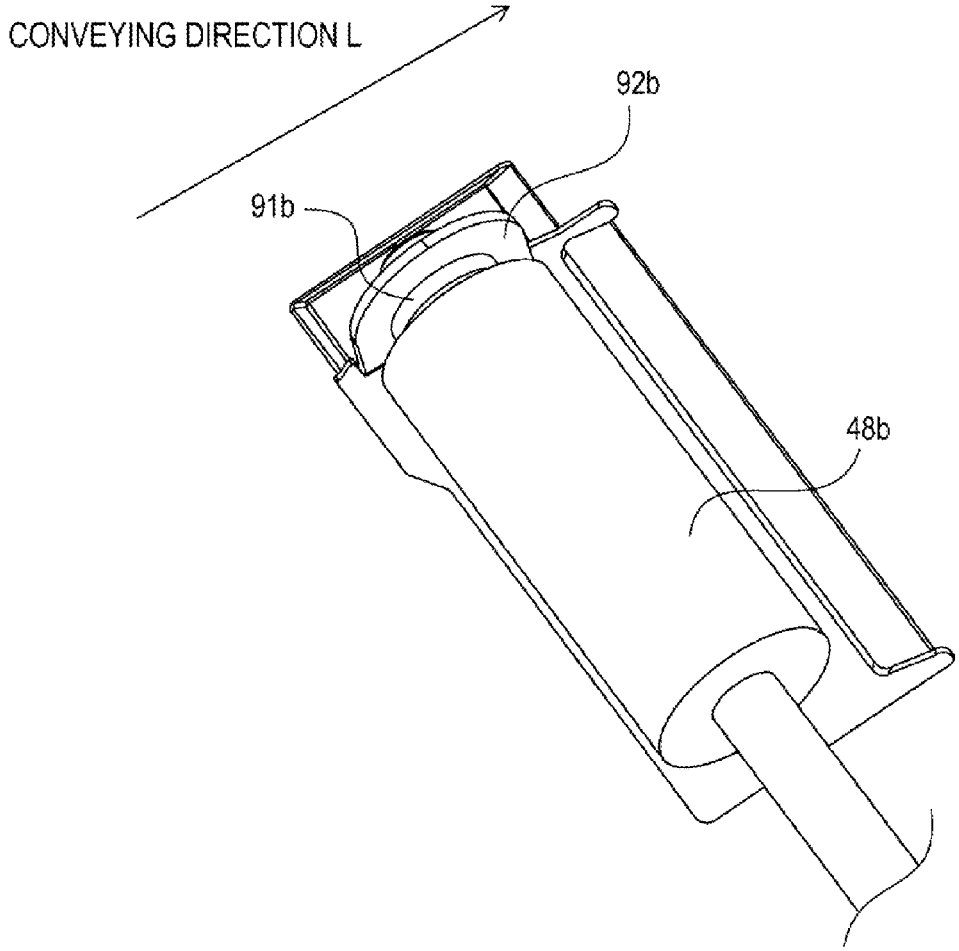
FIG. 4 is a back-side perspective view of FIG. 3 illustrating a back side of the conveying surface near the roller bearing.
Figure 5:
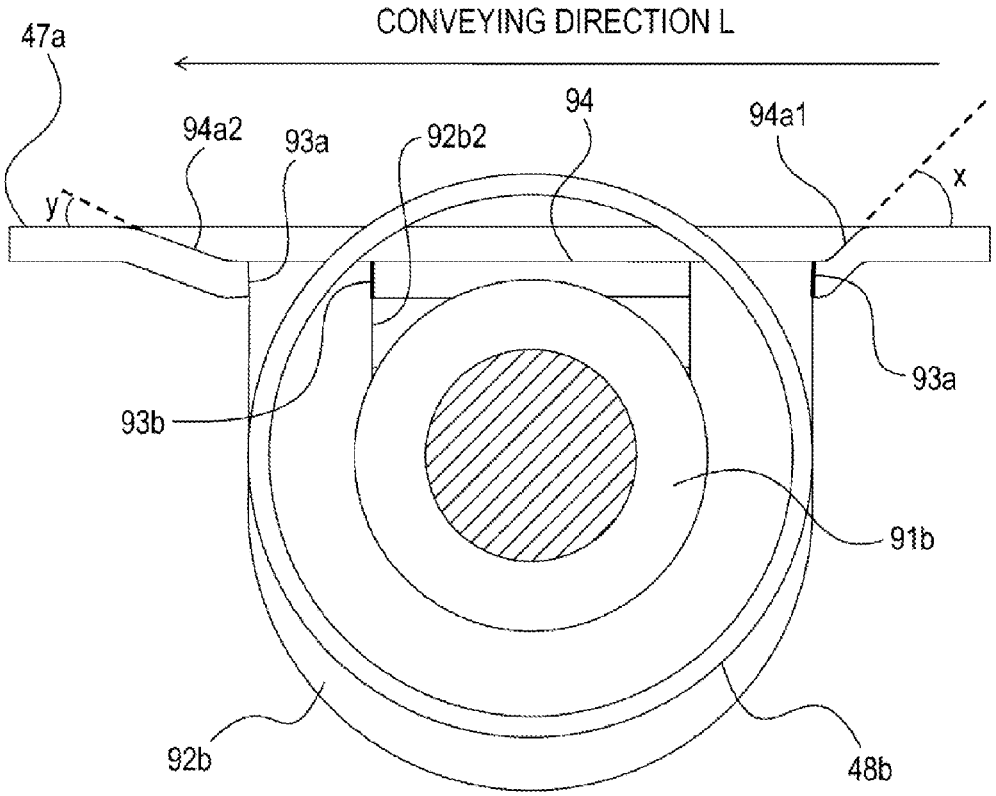
FIG. 5 is a cross-sectional view taken along a line A illustrated in FIG. 3.

FIG. 2 is a perspective view seen from conveying surface 47*a* side, illustrating the peripheral part of the conveying roller 48*b* on the duplex conveying path 47. The conveying roller 48*b* provided as a rotating portion is rotatable around an axis along a width direction, orthogonal to the sheet conveying direction, of the sheet S. The conveying roller 48*b* is rotatably supported by a bearing 91*b*. FIG. 3 is an enlarged perspective view of FIG. 2 seen from the conveying surface 47*a* side, illustrating the peripheral part of the bearing 91*b*. FIG. 4 is a back-side perspective view of FIG. 3 seen from the opposite side of the conveying surface 47*a* side, illustrating the peripheral part of the bearing 91*b*. FIG. 5 is a cross-sectional view taken along the line A (virtual line) illustrated in FIG. 3.

As illustrated in the drawings, a conveying guide 200 functioning as a guiding portion which guides a sheet in the sheet conveying apparatus includes a plate provided with the conveying surface 47*a*, a recess surface portion 94, and a bearing guide 92*b* as a bend portion. The conveying surface 47*a* is a guide surface which contacts and guides the sheet S to be conveyed. The recess surface portion 94 is formed by applying a drawing process on the plate so that a recess is formed from the conveying surface 47*a* which guides the sheet to be conveyed. Further, the recess surface portion 94 includes a recess surface (recess portion) 94*a* as a bottom surface. The bearing guide 92*b* is a part bent in a recessing direction from the recess surface portion 94 (in a direction away from the conveying surface 47*a*). Further, an arc-shaped R portion 92*b*1 is formed in a base end side of the bearing guide 92*b*. In the present embodiment, a high-speed image forming apparatus is assumed. Therefore, the duplex conveying path 47 is formed of the plate material to prevent the sheet from clinging to the conveying guide 200 due to electrification.

Additionally, as illustrated in FIG. 5, the bearing guide 92*b* of the conveying guide 200 is formed in a U-shape to support the bearing 91*b* of the conveying roller 48*b*, and the bearing 91*b* is fitted into an inner opening 92*b*2. The conveying roller 48*b* which conveys the sheet S is attached to the conveying guide 200 via the bearing 91*b*. The bearing 91*b* rotatably supports both ends of the conveying roller 48*b*. A support portion which supports the bearing includes the bearing guide 92*b* and the opening 92*b*2.

As the conveying guide 200 is molded from the plate, bend relief portions 93*a*, 93*a* are required on the recess surface portion 94 when cutting up (bending up) the bearing guide 92*b* from the duplex conveying path 47. The bend relief portions 93*a*, 93*a* are to be processed in advance in order to have a small clearance at a base of the bending part so that material crack or insufficient bending may be prevented in course of the cutting-up process. As illustrated in FIGS. 3 and 5, the bend relief portions 93*a*, 93*a* are formed on the recess surface portion 94 on the base end side of the bearing guide 92*b*. As the axial direction of the conveying roller 48 is orthogonal to the sheet conveying direction L, an extending direction of the bend relief portions 93*a*, 93*a* is also set to a direction orthogonal to the sheet conveying direction L. Here, there is a possibility that the front end of the sheet to be conveyed may be caught in the bend relief portions 93*a*, 93*a* because the bend relief portions 93*a*, 93*a* are formed in the direction orthogonal to the sheet conveying direction L. There is also a possibility that the front end of the sheet to be conveyed may be caught in an edge portion 93*b* orthogonal to the sheet conveying direction L. The edge portion 93*b* is located in the above-described opening 92*b*2 formed in the bearing guide 92*b*.

To solve this problem, to allow the bend relief portions 93*a*, 93*a* and the edge portion 93*b* in the opening 92*b*2 escape from the conveying surface 47*a* and prevent the sheet S from being caught or dropped, the recess surface 94*a* is formed in the periphery of the bend relief portions 93*a*, 93*a* by drawing in a direction away from the conveying surface 47*a*. That is, the recess surface portion 94 is formed by drawing the conveying guide 200 in a range including the bend relief portions 93*a*, 93*a* and the bearing guide 92*b*. Therefore, the bend relief portions 93*a*, 93*a* and the edge portion 93*b* in the opening 92*b*2 are located at positions more recessed than the conveying surface 47*a*.

It is better to have a farther distance between the recess surface 94*a* and the conveying surface 47*a* because the bend relief portions 93*a*, 93*a* and the edge portion 93*b* in the opening 92*b*2 are located in the recess surface portion 94. Here, the recess surface 94*a* expands in a direction parallel to the conveying surface 47*a*. However, it should be noted that the recess surface 94*a* does not have to expand in the direction parallel to the conveying surface 47*a* and may be tilted to some degree relative to the conveying surface 47*a*.

In addition, a first slope 94*a*1, which links the conveying surface 47*a* with the recess surface 94*a*, is formed by the drawing process in an upstream side of the recess surface portion 94 in the sheet conveying direction L. An inclination angle x (a first inclination angle x of the first slope 94*a*1 with respect to the recess surface 94*a*) formed by drawing the upstream side in the sheet conveying direction is set at a large angle value so as to prevent the sheet S, which has been conveyed from the conveying surface 47*a* to the recess surface 94*a*, from being caught in the bend relief portion 93*a*.

Further, a second slope 94*a*2, which links the conveying surface 47*a* with the recess surface 94*a*, is formed by the drawing process in a downstream side of the recess surface portion 94 in the sheet conveying direction L. Further, an inclination angle y (a second inclination angle y of a second slope 94*a*2 with respect to the recess surface 94*a*) formed by drawing the downstream side in the sheet conveying direction is set at a small angle value so as to prevent the sheet S to be conveyed from the recess surface 94*a* to the conveying surface 47*a* from being caught in the second slope 94*a*2. That is, the inclination angle x is set larger than the inclination angle y.

The bearing guide 92*b* extends in a direction vertical to the conveying surface 47*a*. However, the bearing guide 92*b* does not have to extend in the direction vertical to the conveying surface 47*a* and may extend in a direction tilted relative to the conveying surface 47*a*.

According to an embodiment of the present invention, the bend relief portions 93*a*, 93*a* and the edge portion 93*b* in the opening 92*b*2 are not projected from the conveying surface 47*a*. Therefore, it is possible to reduce occurrence of a sheet jam and damage on an image surface caused by the sheet S being caught in the bend relief portions 93*a*, 93*a* and the edge portion 93*b* in the opening 92*b*2. Further, the cost may be also reduced as the present invention provides flexibility in the method of integrally forming the conveying guide 200 by using the plate material. Moreover, as the weight of the apparatus and the unit is reduced, the user's operability and the serviceman's workability may be improved.

In the present embodiment, the bearing support portion of the roller has been described. However, the present invention is not limited to this embodiment but may be applicable to any support portion which supports a function portion of the conveying guide, such as a sensor which detects a timing of conveyance and a support portion which supports a sensor flag of the sensor. That is, for instance, the sensor flag rotated by being pushed by the sheet to be conveyed may be rotatably supported at the bend portion. The sensor flag configured as a rotating portion is rotated around an axis along the sheet width direction orthogonal to the sheet conveying direction. The sensor flag activates a photo-interrupter, thereby detecting the sheet based on a signal from the photo-interrupter.

According to an embodiment of the present invention, it is possible to reduce occurrence of the sheet jam and the damage on an image surface caused by the sheet being caught in the bend relief portion as the bend relief portion is not projected from the conveying surface.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-188454, filed Aug. 29, 2012, which is hereby incorporated by reference herein in its entirety.

What is claimed is:

1. A conveying guide comprising:

a plate having a guide surface which guides a sheet, the guide surface being linear in both a sheet conveying direction and a direction perpendicular to the sheet conveying direction;

a recess surface which is a surface of the plate recessed from the guide surface, the recess surface located at an area through which a guided sheet passes; and a bend portion which is a portion of the plate and bent from the recess surface in a direction away from the guide surface to define an edge with the recess surface, a surface of the bend portion crossing a direction orthogonal to a sheet conveying direction, wherein the surface of the bend portion has an opening.

2. The conveying guide according to claim 1, wherein the recess surface includes a relief portion for forming the bend portion.

3. The conveying guide according to claim 1, wherein a bottom surface of the recess surface extends parallel to the guide surface.

4. The conveying guide according to claim 1, further comprising:

a first slope formed on an upstream side of the recess surface in a sheet conveying direction to link the guide surface with the recess surface; and a second slope formed on a downstream side of the recess surface in the sheet conveying direction to link the guide surface with the recess surface, wherein a first inclination angle of the first slope relative to the recess surface is set larger than a second inclination angle of the second slope relative to the recess surface.

5. The conveying guide according to claim 1, wherein the bend surface extends in a direction inclined relative to the guide surface.

6. The conveying guide according to claim 1, wherein the bend surface extends in a direction vertical to the guide surface.

7. A sheet conveying apparatus comprising:

a conveying roller which conveys a sheet;

a bearing which rotatably supports both ends of the conveying roller; and the conveying guide according to claim 1, wherein an inner surface of the opening supports the bearing.

8. The conveying guide according to claim 1, wherein the recess surface is formed by applying a drawing process.

9. A sheet conveying apparatus comprising:

a plate having a guide surface which guides a sheet, the guide surface being linear in both a sheet conveying direction and a direction perpendicular to the sheet conveying direction;

a recess surface which is a surface of the plate recessed from the guide surface, the recess surface located at an area through which a guided sheet passes;

a bend portion which is a portion of the plate and bent from the recess surface in a direction away from the guide surface to define an edge with the recess surface, a surface of the bend portion crossing a direction orthogonal to a sheet conveying direction; and a rotating portion rotatably supported at the bend portion, wherein the surface of the bend portion has an opening, and wherein the rotating portion rotates around an axis extending along a direction orthogonal to a sheet conveying direction and the axis extends through the opening.

10. The sheet conveying apparatus according to claim 9, wherein the recess surface is formed to include a relief portion for forming the bend portion.

11. The sheet conveying apparatus according to claim 9, wherein the rotating surface is a conveying roller which conveys a sheet.

12. The sheet conveying apparatus according to claim 11, wherein an inner surface of the opening supports a bearing which rotatably supports the conveying roller.

13. The sheet conveying apparatus according to claim 9, wherein a bottom surface of the recess surface extends parallel to the guide surface.

14. The sheet conveying apparatus according to claim 9, further comprising:

a first slope formed on an upstream side of the recess surface in a sheet conveying direction to link the guide surface with the recess surface; and a second slope formed on a downstream side of the recess surface in the sheet conveying direction to link the guide surface with the recess surface, wherein a first inclination angle of the first slope relative to the recess surface is set larger than a second inclination angle of the second slope relative to the recess surface.

15. The sheet conveying apparatus according to claim 9, wherein the bend surface extends in a direction vertical to the guide surface.

16. The sheet conveying apparatus according to claim 9, wherein the recess surface is formed by applying a drawing process.

17. The sheet conveying apparatus according to claim 9, wherein an inner surface of the opening is formed by inner edges of the plate.

18. The sheet conveying apparatus according to claim 9, wherein the plate has an upstream edge facing to the rotation portion at an upstream side of the sheet conveying direction and the upper edge comprises a first part at a close position from the bend position and a second part at a far position from the bend portion, the first portion having larger distance to the rotation portion than the second portion.

19. The sheet conveying apparatus according to claim 9, wherein the plate has an upstream edge which faces to the rotation portion to be straight in the sheet conveying direction and a downstream edge which faces to the rotation portion to be bend downward from the guide surface in opposite direction of the sheet conveying direction.

20. The sheet conveying apparatus according to claim 18, wherein the rotation portion is a driven roller.

21. The sheet conveying apparatus according to claim 19, wherein the rotation portion is a driven roller.

22. The sheet conveying apparatus according to claim 18, wherein the plate is for a duplex conveying path.

23. The sheet conveying apparatus according to claim 19, wherein the plate is for a duplex conveying path.

24. An image forming apparatus comprising:

an image forming portion which forms an image; and a sheet conveying apparatus, wherein the sheet conveying apparatus comprises:

a plate having a guide surface which guides a sheet, the guide surface being linear in both a sheet conveying direction and a direction perpendicular to the sheet conveying direction;

a recess surface which is a surface of the plate recessed from the guide surface, the recess surface located at an area through which a guided sheet passes; and a bend portion which is a portion of the plate and bent from the recess surface in a direction away from the guide surface to define an edge with the recess surface, a surface of the bend portion crossing a direction orthogonal to a sheet conveying direction; and a rotating portion rotatably supported at the bend portion, wherein the surface of the bend portion has an opening, and wherein the rotating portion rotates around an axis extending along the direction orthogonal to a sheet conveying direction and the axis extends through the opening.

25. The sheet conveying apparatus according to claim 24, wherein the plate has an upstream edge facing to the rotation portion at an upstream side of the sheet conveying direction and the upper edge comprises a first part at a close position from the bend position and a second part at a far position from the bend portion, the first portion having larger distance to the rotation portion than the second portion.

26. The sheet conveying apparatus according to claim 24, wherein the plate has an upstream edge which faces to the rotation portion to be straight in the sheet conveying direction and a downstream edge which faces to the rotation portion to be bend downward from the guide surface in opposite direction of the sheet conveying direction.

27. The sheet conveying apparatus according to claim 25, wherein the rotation portion is a driven roller.

28. The sheet conveying apparatus according to claim 26, wherein the rotation portion is a driven roller.

29. The sheet conveying apparatus according to claim 25, wherein the plate is for a duplex conveying path.

30. The sheet conveying apparatus according to claim 26, wherein the plate is for a duplex conveying path.

* * * * *